US008266995B2

(12) United States Patent
Takashimizu

(10) Patent No.: US 8,266,995 B2
(45) Date of Patent: Sep. 18, 2012

(54) PAPER PROCESSING DEVICE

(75) Inventor: Yoshihiro Takashimizu, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 542 days.

(21) Appl. No.: 12/260,897

(22) Filed: Oct. 29, 2008

(65) Prior Publication Data

US 2009/0158902 A1 Jun. 25, 2009

(30) Foreign Application Priority Data

Dec. 25, 2007 (JP) ..... 2007-332917

(51) Int. Cl.
*B26D 1/00* (2006.01)

(52) U.S. Cl. ..... 83/408; 83/302; 83/508.1

(58) Field of Classification Search ..... 83/408, 83/301, 302, 303, 304, 305, 508.1
See application file for complete search history.

(56) References Cited

U.S. PATENT DOCUMENTS 4,265,152 A * 5/1981 Corradi ..... 83/302
5,360,161 A * 11/1994 Schaller et al. ..... 83/408
5,596,918 A * 1/1997 Longwell et al. ..... 83/408
6,568,304 B2 * 5/2003 Ito et al. ..... 83/13
6,684,749 B2 * 2/2004 Adami ..... 83/408
6,893,520 B2 * 5/2005 Cummings et al. ..... 83/408

FOREIGN PATENT DOCUMENTS

| | | | |
|---|---|---|---|
| EP | 0607084 | A1 | 7/1994 |
| JP | 52-14586 | U | 2/1977 |
| JP | 59-134696 | A | 8/1984 |
| JP | 61-152392 | A | 7/1986 |
| JP | 2005-246514 | A | 9/2005 |
| JP | 2005-342827 | A | 12/2005 |

OTHER PUBLICATIONS

Japanese Office Action dated Jan. 26, 2010 for Japanese Patent Application No. 2007-332917 and English-language translation.

* cited by examiner

*Primary Examiner* — Stephen Choi
(74) *Attorney, Agent, or Firm* — Sughrue Mion, PLLC

(57) ABSTRACT

A paper processing device including: a first cutting unit that cuts a transported continuous paper along a transporting direction of the continuous paper to change a width of the continuous paper; a second cutting unit that cuts continuous papers, which are formed by cutting with the first cutting unit, along a width direction of the cut continuous papers to cut the continuous papers into papers of a desired size, the second cutting unit including plural second cutting members disposed along the width direction of the cut continuous papers, and plural driving units that respectively drive the second cutting members are provided.

13 Claims, 14 Drawing Sheets

PAPER PROCESSING DEVICE

CROSS-REFERENCE TO RELATED APPLICATION

This application is based on and claims priority under 35 USC 119 from Japanese Patent Application No. 2007-332917 filed Dec. 25, 2007.

BACKGROUND

1. Technical Field

The present invention relates to a paper processing device that cuts continuous paper that is transported.

2. Related Art

In large-quantity high-speed printing, conventionally, continuous paper with which a large quantity of paper can be handled is used in a configuration such as a roll paper. In this continuous paper processing system, post-processing such as cutting, binding, stitching, inserting and enclosing/sealing cut paper for printed matter corresponding to purpose can be performed by a post-processing machine being from a continuous paper supplying device via a printing machine or printer device (including a rotary press or digital printer) or by combining a post-processing machine with a supply device of continuous paper that has been printed and is rolled into a roll.

In a cutting unit that performs cutting of the continuous paper, processing is performed in which the continuous paper is cut in the length direction (transporting direction) and the width direction (direction orthogonal to the transporting direction) of the continuous paper to correspond to a predetermined paper size. Additionally, downstream of the cutting unit in the transporting direction of the continuous paper, there is disposed a waste paper collection bin called a purge, and unnecessary cut pieces (unnecessary portions) that have been cut by the cutting unit are collected therein. On the other hand, cut paper (paper) during a printing job is transported to a post-processing machine on the downstream side of the cutting unit, or the paper transporting path is switched per purpose and the cut paper is guided to a predetermined stacker.

In processes pertaining to the continuous paper, it is demanded that the continuous paper is cut into the necessary size while being transported at a high speed and is transported to the necessary processing unit.

A cutting mechanism in a conventional device cuts the entire width of the paper in batch manner by a rotary cutter shaft, so it cannot perform cutting operation to change the width in a right-angle direction to the transporting of the paper that is to be cut. Further, when the paper has been cut along the paper transporting direction by the above-described slitter, the entire width ends up being cut in batch manner by the rotary cutter in the cutting mechanism. So, when the paper is to be cut in the width direction of the paper at a different place in the transporting direction, it has been necessary to largely separate each of the paper transporting positions after cutting, to transport one paper to another paper cutting unit via a different paper transporting path, and to process that paper.

Even in the above-described continuous paper processing system, in the publication of a small number of printed matter on-demand, and particularly in DM printing and invoices that are of a large quantity but are different, the demand for a variable post-processing machine that speedily processes papers is rising.

Among this, there is also a demand to process, in batch manner, forms (ledger, slip and the like) of different paper sizes, but in the continuous paper processing system, switching between paper sizes is not easy in comparison to cut paper because of the configuration of that paper. So, it has been difficult to variably perform paper cutting at a high speed in correspondence to various printing output while maintaining high speed.

For example, different forms cannot be collectively processed, and not only does setup work that is necessary between jobs in accompaniment with frequent paper size changing become a significant factor in a drop in total performance but it also leads to needless consumption of paper due to paper switching and setup.

Particularly in switching paper sizes in the width direction of the paper, it is necessary to switch the paper itself and to adjust the position of the tooth of the cutter mechanism, that work requires a large amount of time, and not only does this hinder high-speediness, but a large quantity of paper also becomes necessary for positional adjustment, and sometimes seam in the continuous paper causes a problem in the downstream side post-processing machine.

Further, even when the size in the paper transporting direction is to be switched, the continuous paper ends up being cut in batch manner by the rotary cutter or the like that is used in order to correspond high speed, and the continuous paper cannot be cut into different sizes by a single device, so not only does the system become significantly complex and expensive in accompaniment with an increase in the complexity of the processing, but also a significant drop in operating efficiency has also been seen, such as papers that have been cut in the paper transporting direction being divided and transported to different post-processing machines and being cut by separately installed cutting devices

SUMMARY

In an aspect of the invention, there is provided a paper processing device including: a first cutting unit that cuts a transported continuous paper along a transporting direction of the continuous paper to change a width of the continuous paper; a second cutting unit that cuts continuous papers, which are formed by cutting with the first cutting unit, along a width direction of the cut continuous papers to cut the continuous papers into papers of a desired size, the second cutting unit including a plurality of second cutting members disposed along the width direction of the cut continuous papers, and a plurality of driving units that respectively drive the second cutting members.

BRIEF DESCRIPTION OF THE DRAWINGS

An exemplary embodiment of the invention will be described in detail with reference to the following figures, wherein.

DETAILED DESCRIPTION

Below, an exemplary embodiment of the present invention will be described in detail with reference to the drawings.

Figure 1:
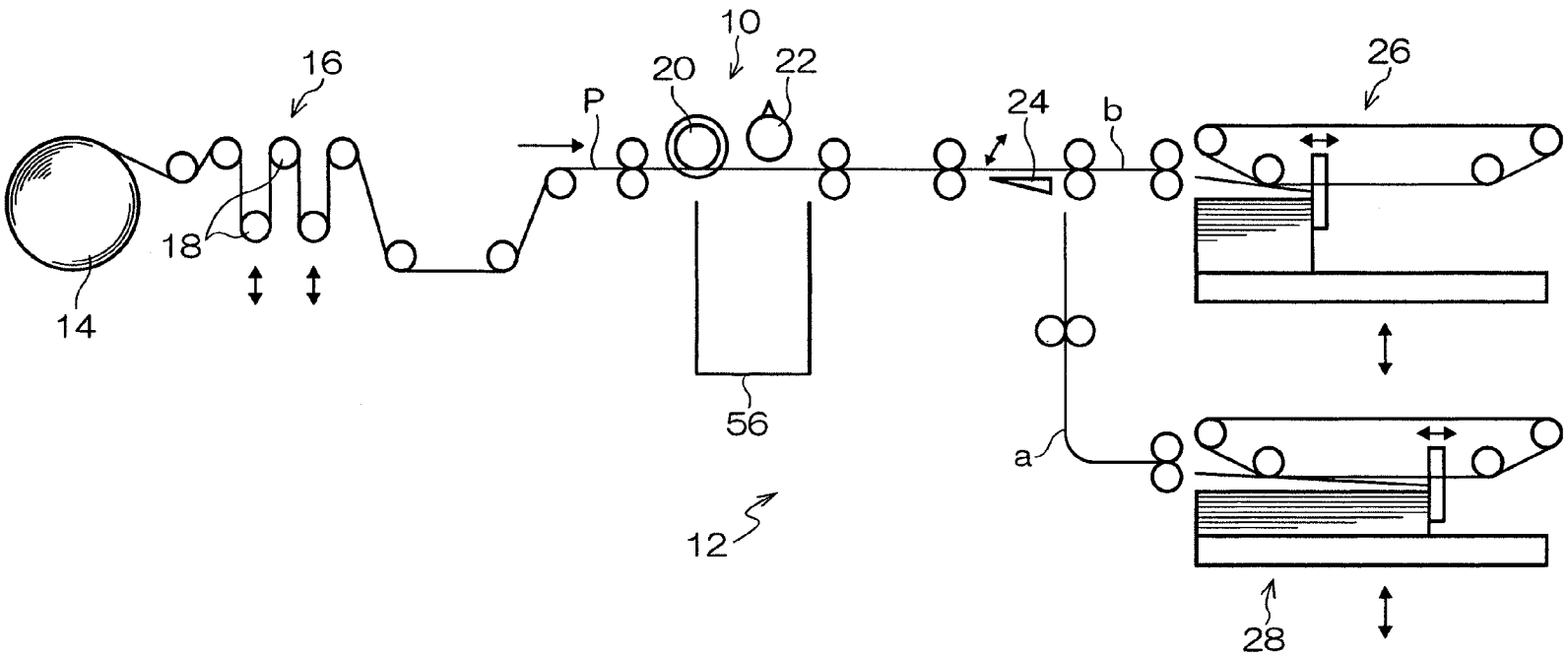
FIG. 1 is an overall diagram showing the configuration of a paper processing system.

FIG. 1 is a diagram showing the overall configuration of a paper processing system 12 to which a paper processing device 10 pertaining to the present exemplary embodiment is applied. The paper processing device 10 configures part of the paper processing system 12 and is an device that cuts continuous paper P that is transported into a predetermined size.

On an upstream side of the paper processing system 12 in a transporting direction of the continuous paper P (sometimes simply called "the upstream side" below), there is disposed a continuous paper supplying device 14 that sequentially unrolls the continuous paper P that has been rolled beforehand into a roll.

On a downstream side of this continuous paper supplying device 14 in the transporting direction of the continuous paper P (sometimes simply called "the downstream side" below), there is disposed a paper buffer mechanism 16, and the continuous paper P is transported in a state where the continuous paper P has been wrapped around rollers 18 that are alternately disposed up and down.

The rollers 18 that are positioned on the lower side of the paper buffer mechanism 16 are configured to be movable up and down, whereby these rollers 18 adjust the tension in the continuous paper P and prevent problems such as the continuous paper P being pulled and cut or the continuous paper P becoming slack and crimping.

On the downstream side of this paper buffer mechanism 16, there is disposed the paper processing device 10 pertaining to the present exemplary embodiment, and the paper processing device 10 cuts the continuous paper P into a predetermined size. It will be noted that, here, the paper processing device 10 is disposed on the upper portion of the continuous paper P that is transported, but the paper processing device 10 may also be disposed on the lower portion of the continuous paper P that is transported. Further, although it is not shown, a printing device that is capable of forming an image may be disposed between the paper buffer mechanism 16 and the paper processing device 10, and the continuous paper P on which an image has been formed may be cut into a predetermined size by the paper processing device 10.

<Paper Processing Device>

Here, the paper processing device 10 will be described.

Figure 3A:
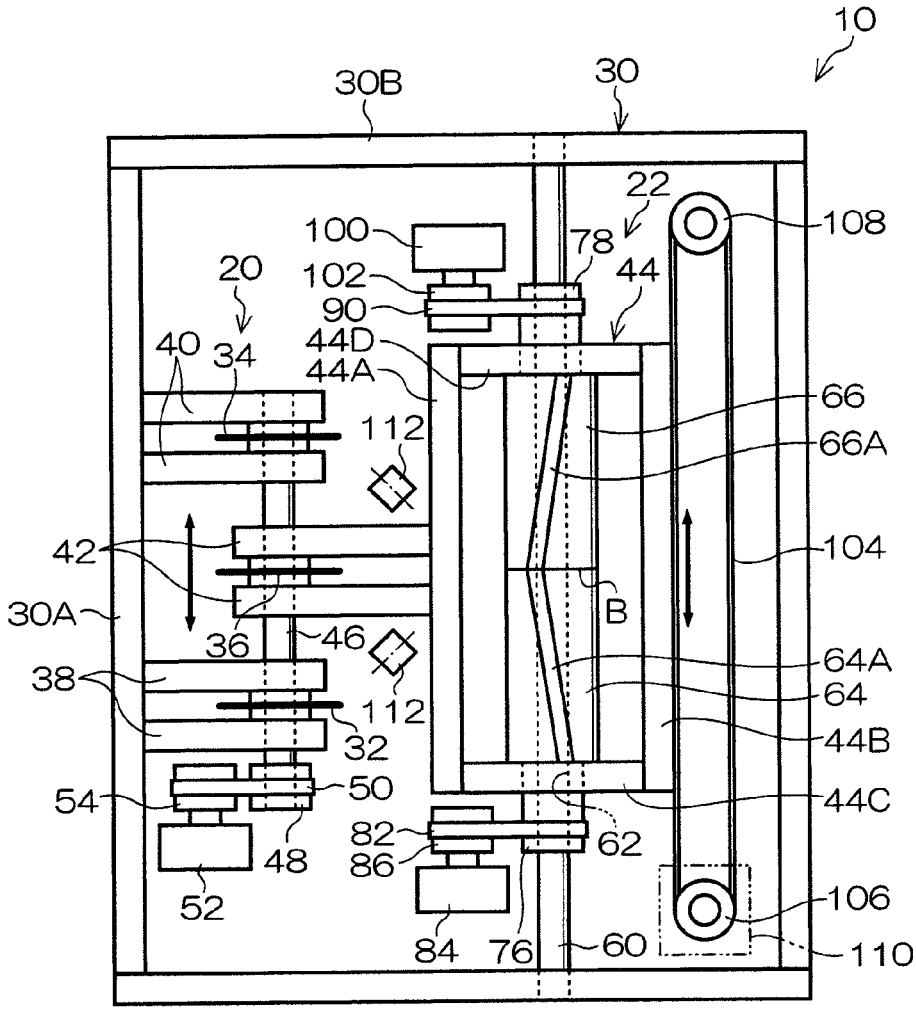
FIG. 3A and FIG. 3B are diagrams showing the paper processing device pertaining to the exemplary embodiment, with FIG. 3A being a plan diagram and FIG. 3B being a front diagram.
Figure 3B:
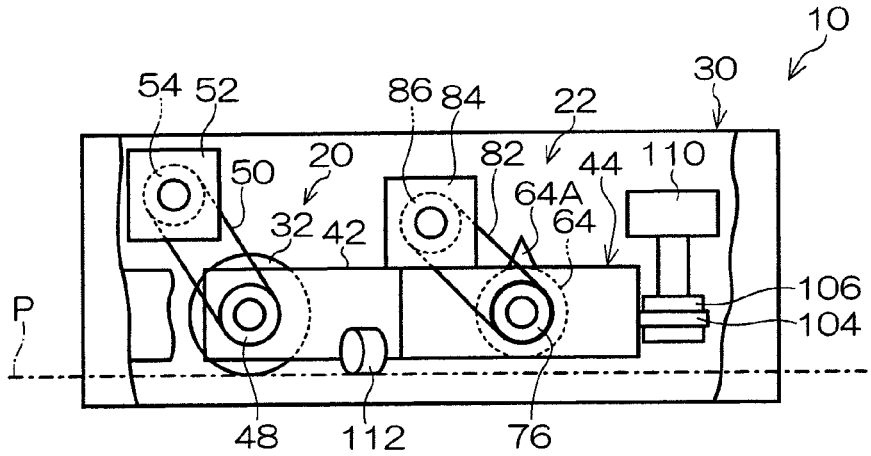

As shown in FIG. 1, FIG. 3A and FIG. 3B, in the paper processing device 10, on the upstream side thereof, there is disposed a slitter unit (a first cutting unit) 20 that cuts the continuous paper P along the transporting direction of the continuous paper P. On the downstream side of the slitter unit 20, there is disposed a cutter unit (a second cutting unit) 22 that cuts the continuous paper P along a direction that is orthogonal to the transporting direction of the continuous paper P (i.e., along a width direction of the continuous paper P).

(Slitter Unit)

Figure 2:
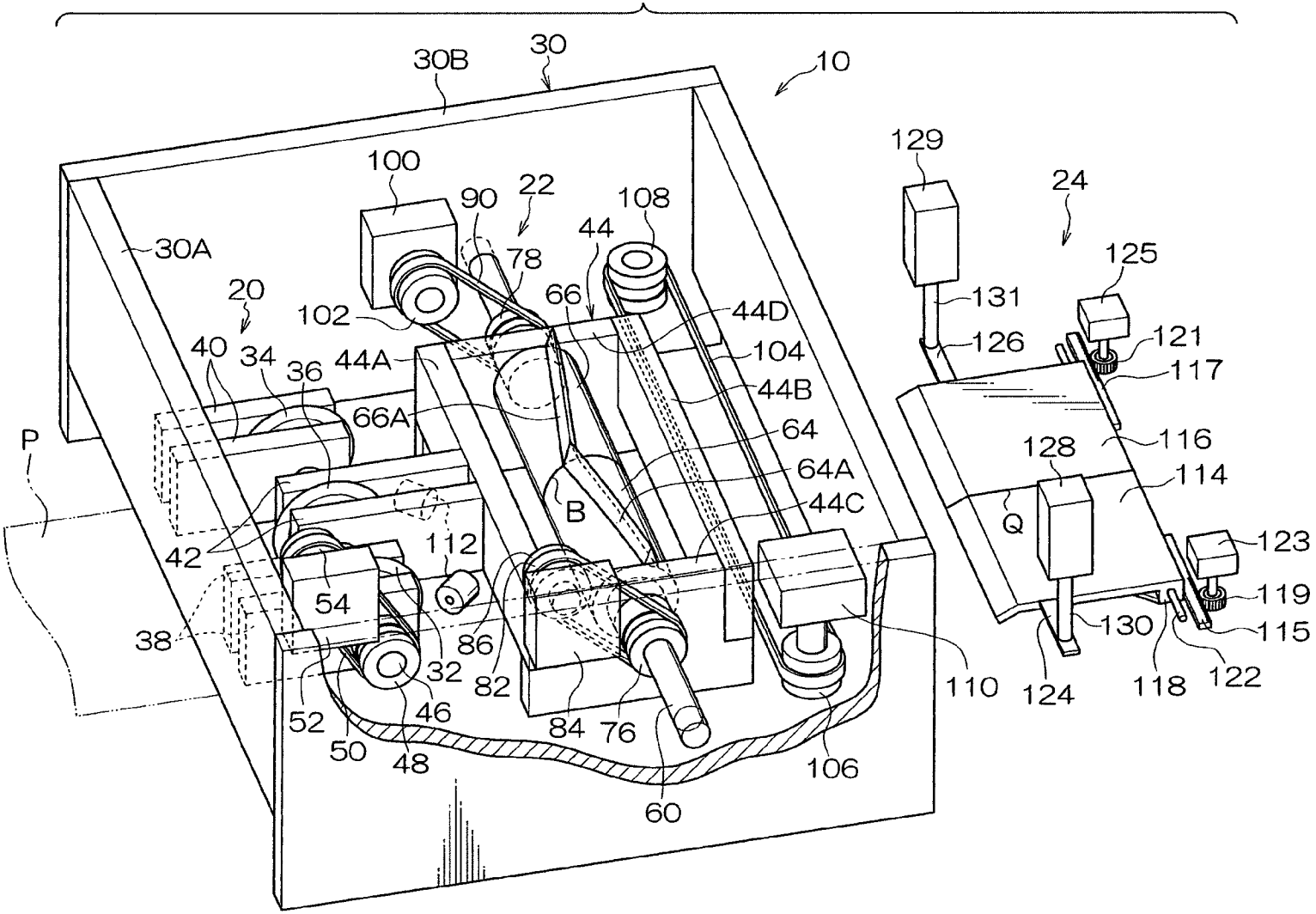
FIG. 2 is a perspective diagram showing a paper processing device and a paper guiding device pertaining to the exemplary embodiment.

As shown in FIG. 2, FIG. 3A and FIG. 3B, the slitter unit 20 is configured by slitters 32, 34 and 36 that are disposed, along the width direction of the continuous paper P that is transported, on the upstream side of the inside of a frame body 30 of the paper processing device 10. Each of the slitters 32, 34 and 36 has substantially disc-shape and a blade portion thereof is projected from a transporting surface of the continuous paper P. It will be noted that plural transporting rollers are disposed along the transporting direction of the continuous paper P on the transporting surface, but illustration thereof is omitted.

For convenience of description, the slitters 32 and 34 that are disposed on both end sides in the width direction of the continuous paper P that is transported will be called side slitters 32 and 34, and the slitter 36 that is disposed in the central portion in the width direction of the continuous paper P will be called a center slitter 36. It will be noted that, here, three slitters are disposed, but only the center slitter 36 may also be disposed, or two of the center slitters 36 may also be disposed.

On a support plate 30A that is positioned on the upstream side of the frame body 30, on both end sides of the continuous paper P that is transported, a pair of shaft support plates 38 and a pair of shaft support plates 40 extend along the transporting direction of the continuous paper P. Further, a pair of shaft support plates 42 is disposed between the shaft support plates 38 and the shaft support plates 40, and these shaft support plates 42 are disposed on a support body 44 of the later-described cutter unit 20. The details thereof will be described later.

Further, a shaft 46 penetrates the shaft support plates 38, 42 and 40 and is configured to be rotatable with respect to the shaft support plates 38, 42 and 40. The side slitter 32 is fixed to the shaft 46 and is disposed between the support plates 38, the side slitter 34 is fixed to the shaft 46 and is disposed between the support plates 40, and the center slitter 36 that is rotational-prevented (described later) on the shaft 46 is disposed between the support plates 42.

A pulley 48 is disposed on one end portion of the shaft 46, and a drive belt 50 is wrapped around the pulley 48. This drive belt 50 is wrapped around a pulley 54 that is coupled to a drive motor 52 that is disposed on the frame body 30, and driving force from the drive motor 52 is transmitted to the shaft 46 via the pulley 54, the drive belt 50 and the pulley 48. Due to the rotation of this shaft 46, the side slitters 32 and 34 and the center slitter 36 respectively rotate.

Both end portions of the continuous paper P in the width direction thereof are cut off by the side slitters 32 and 36. These regions that are cut off are collected in a waste paper collection bin 58 (see FIG. 1), as unnecessary portions 56 shown in FIG. 4, and the continuous paper P is divided in the width direction thereof into continuous paper A and continuous paper B (here, two) by the center slitter 36 and transported to the cutter unit 22.

It will be noted that, here, the unnecessary portions 56 are collected in the waste paper collection bin 58 on the upstream side of the cutter unit 22, but the unnecessary portions 56 may also be collected in the waste paper collection bin 58 on the downstream side of the cutter unit 22. The unnecessary portions 56 that are collected on the upstream side of the cutter unit 22 are continuous, but the unnecessary portions 56 that are collected on the downstream side of the cutter unit 22 become chips.

Figure 5:
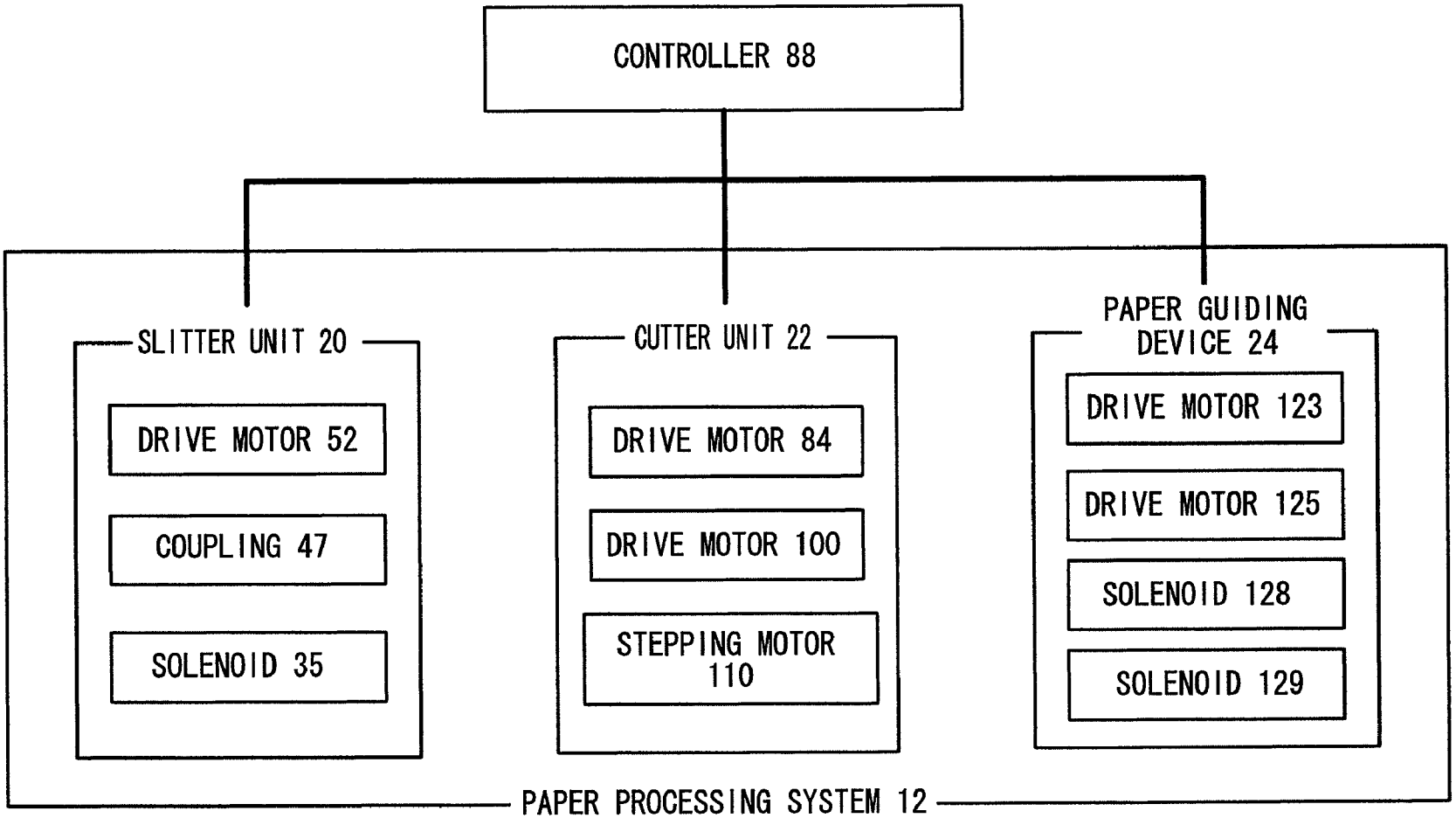
FIG. 5 is a block diagram showing the configuration of a control system of the paper processing device and the paper guiding device pertaining to the exemplary embodiment.

Further, although it is not illustrated, the shaft 46 (see FIG. 2) is configured by plural shafts, and these shafts are coupled together by an electromagnetic coupling 47 (see FIG. 5). This coupling 47 is connected to a controller 88 (see FIG. 5) that controls the paper processing system 12. In a conductive state, the shafts are coupled to each other via the coupling 47, but in a non-conductive state, the shafts are placed in a non-coupled state to ensure that the driving force from the drive motor 52 is not transmitted.

The side slitter 34 is disposed so as to be capable of being withdrawal with respect to the transporting surface of the continuous paper P that is transported, and is configured to be capable of being withdrawal by a solenoid 35 (see FIG. 5) that is connected to the controller 88.

Specifically, in a state where the solenoid 35 is OFF, the side slitter 34 is placed in a cutting state and is positioned downward (positioned on transporting surface side of the continuous paper P that is transported) to cut the continuous paper P that is transported when the coupling 47 becomes conductive. However, when the coupling 47 becomes non-conductive and the solenoid 35 is switched ON, the side slitter 34 moves upward, such that a clearance is generated between the side slitter 34 and the continuous paper P that is transported, and is placed in a non-cutting state.

For example, there is a case where cutting of the continuous paper P by the side slitter 34 is unnecessary, such as a case where all of the continuous paper P from the cutting position of the center slitter 36 to one end portion side becomes an unnecessary portion 56 (see FIG. 14), and in this case, the side slitter 34 is placed in a non-cutting state.

However, in a case where both end portions of the continuous paper P are invariably to be cut, it is not invariably necessary for the side slitter 34 to be placed in a non-cutting state even in a case where all of the continuous paper P from the cutting position of the center slitter 36 to one end portion side becomes the unnecessary portion 56. In this case, a device such as the solenoid 35 that moves the side slitter 34 up and down becomes unnecessary.

Further, here, only the side slitter 34 is configured to be switchable to a cutting state or a non-cutting state, but all of the slitters may also be configured to be switchable to a cutting state or a non-cutting state.

Moreover, here, the shaft 46 is configured by plural shafts, and those shafts are capable of being coupled together by the electromagnetic coupling 47, but driving units such as motors may also be disposed for each of the side slitters 32 and 34 and the center slitter 36 such that the slitters are driven in a state where they are independent of each other.

(Cutter Unit)

As shown in FIG. 2, FIG. 3 and FIG. 3B, in the cutter unit 22, there is disposed the support body 44 that has a frame-like shape. The support body 44 is disposed with a pair of support plates 44A and 44B, which are disposed along the width direction of the continuous paper P that is transported and facing each other, and support plates 44C and 44D, which couple together both pairs of end portions of these support plates 44A and 44B.

One shaft 60 penetrates the support plates 44C and 44D and is fixed to a side wall 30B of the frame body 30. As one example, these support plates 44C and 44D are configured such that shaft hole 62 portions that the shaft 60 penetrates are dividable in the vertical direction thereof, and after the shaft 60 is supported on the lower portion sides of the shaft holes 62, the upper portion sides of the shaft holes 62 in the support plates 44C and 44D are fixed to the lower portion sides.

The cutter unit 22 is disposed with plural (in the present exemplary embodiment, two) cutting portions 64 and 66 along the width direction of the continuous paper P. These cutting portions 64 and 66 have substantially circular cylinder shapes that have the same length, and blade portions 64A and 66A are respectively formed thereon along the axial direction of the outer peripheral surfaces of the cutting portions 64 and 66.

These blade portions 64A and 66A slant slightly along the axial direction, and this is to reduce the action of load of the blade portions 64A and 66A when cutting the continuous paper P. Here, the angle of inclination is made larger than is actually the case in order to make it easier to understand.

Figure 6:
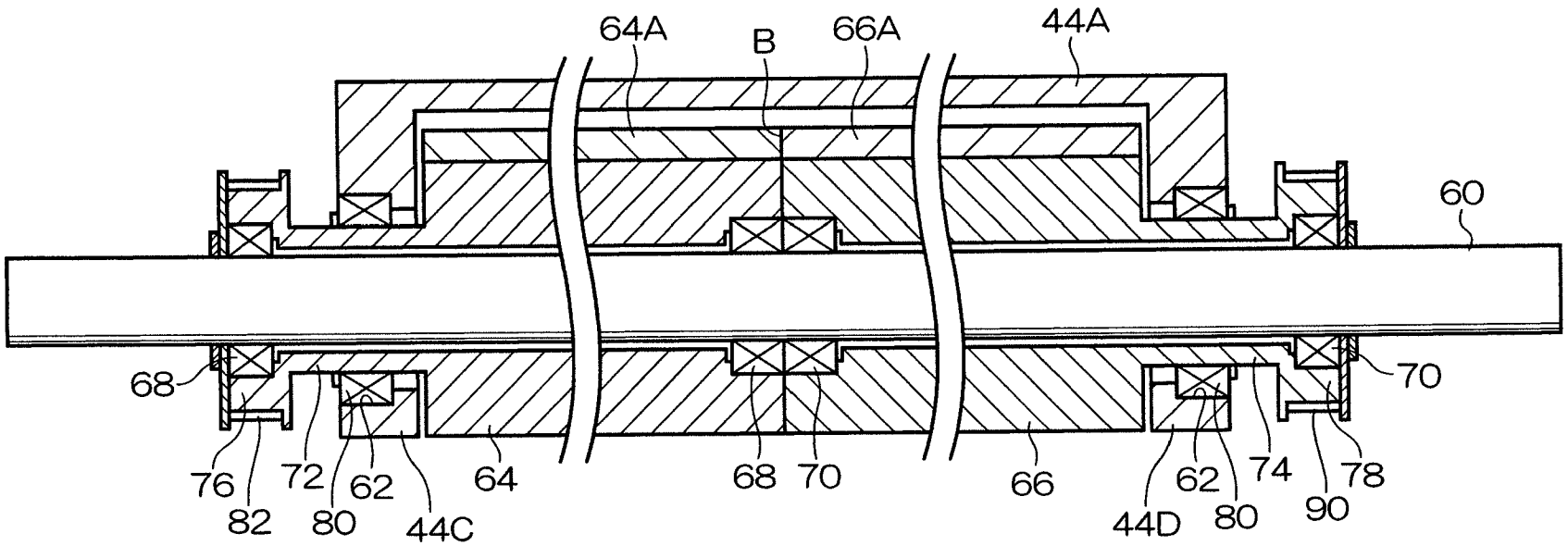
FIG. 6 is a transverse cross-sectional diagram showing the configuration of a cutter unit of the paper processing device pertaining to the exemplary embodiment.

The shaft 60 is inserted through these cutting portions 64 and 66. Additionally, as shown in FIG. 6 (FIG. 6 is a transverse cross-sectional diagram showing the portion of the cutter unit 22 around the shaft 60), the cutting portions 64 and 66 are configured to be respectively rotatable with respect to the shaft 60 via bearings 68 and 70 that are disposed on this shaft 60. Further, small diameter portions 72 and 74 are respectively disposed on the outer sides of the cutting portions 64 and 66, and pulleys 76 and 78 are respectively disposed on the end portions of the small diameter portions 72 and 74.

Here, the pulleys 76 and 78 are disposed on the outer sides of the support plate 44B, so the support plates 44C and 44D pivotally support the small diameter portions 72 and 74. For this reason, bearings 80 are disposed in the shaft holes 62 in the support plates 44C and 44D, and the cutting portions 64 and 66 are configured to be respectively rotatable with respect to the shaft holes 62 via the bearings 80.

Further, as shown in FIG. 2, FIG. 3A and FIG. 3B, a drive belt 82 is wrapped around the pulley 76. The drive belt 82 is wrapped around a pulley 86 that is coupled to a drive motor 84 that is disposed on the support plate 44C, and driving force from the drive motor 84 is transmitted to the cutting portion 64 via the pulley 86, the drive belt 82 and the pulley 76.

The drive motor 84 is connected to the controller 88 (see FIG. 5) that controls the paper processing system 12 and is driven in accordance with an instruction from the controller 88. Additionally, when the drive motor 84 is driven, the cutting portion 64 rotates via the pulley 86, the drive belt 82 and the pulley 76. Due to this rotation, the continuous paper P that is transported under the cutting portion 64 is cut by the blade portion 64A of the cutting portion 64.

A drive belt 90 is wrapped around the pulley 78. The drive belt 90 is wrapped around a pulley 102 that is coupled to a drive motor 100 that is disposed on the support plate 44D, and driving force from the drive motor 100 is transmitted to the cutting portion 66 via the pulley 102, the drive belt 90 and the pulley 78.

The drive motor 100 is, similar to the drive motor 84, connected to the controller 88 of the paper processing system 12 and is driven in accordance with an instruction from the controller 88. Additionally, when the drive motor 100 is driven, the cutting portion 66 rotates via the pulley 102, the drive belt 90 and the pulley 78. Due to this rotation, the continuous paper P is cut by the blade portion 66A of the cutting portion 66.

In other words, the drive motors 84 and 100 that respectively drive the cutting portions 64 and 66 are disposed individually for these cutting portions 64 and 66 such that the cutting portions 64 and 66 are configured to be rotatable in a state where they are independent of each other. It will be noted that it is also possible to mutually synchronize the drive motors 84 and 100 and that it is also possible to cut the entire width of the continuous paper P that is transported in a state where the cutting portions 64 and 66 have been integrated.

The support body 44 is disposed so as to be movable along the width direction of the continuous paper P that is transported. Specifically, a coupling portion (not shown) is disposed on the outer surface of the support plate 44B, and this coupling portion and a drive belt 104 that is disposed along the width direction of the continuous paper P that is transported are coupled to each other.

Figure 7B:
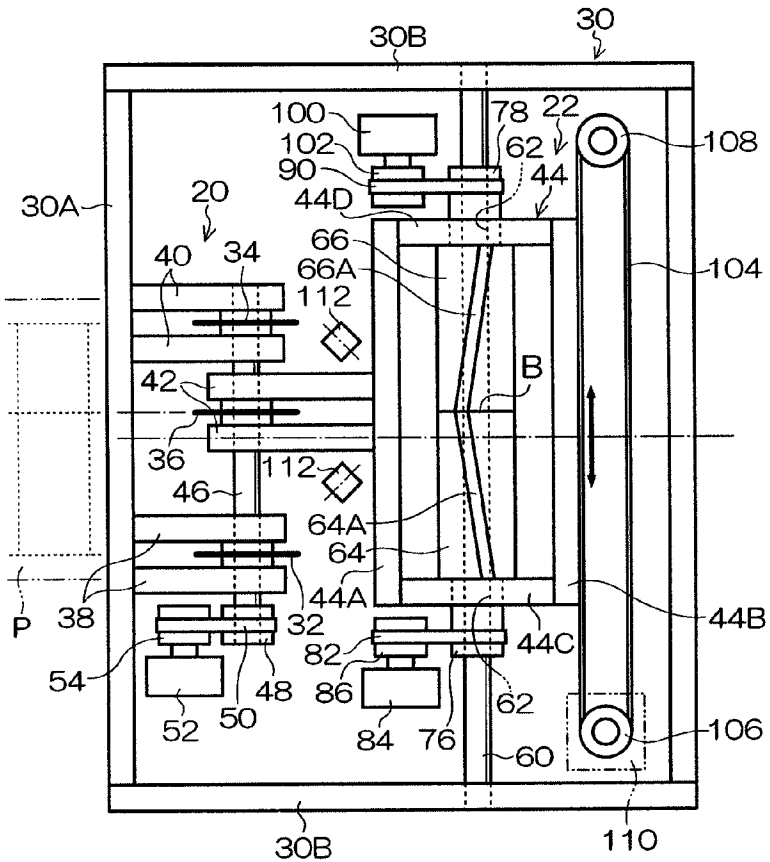
FIG. 7A and FIG. 7B are plan diagrams describing the action of the paper processing device pertaining to the exemplary embodiment.
Figure 7A:
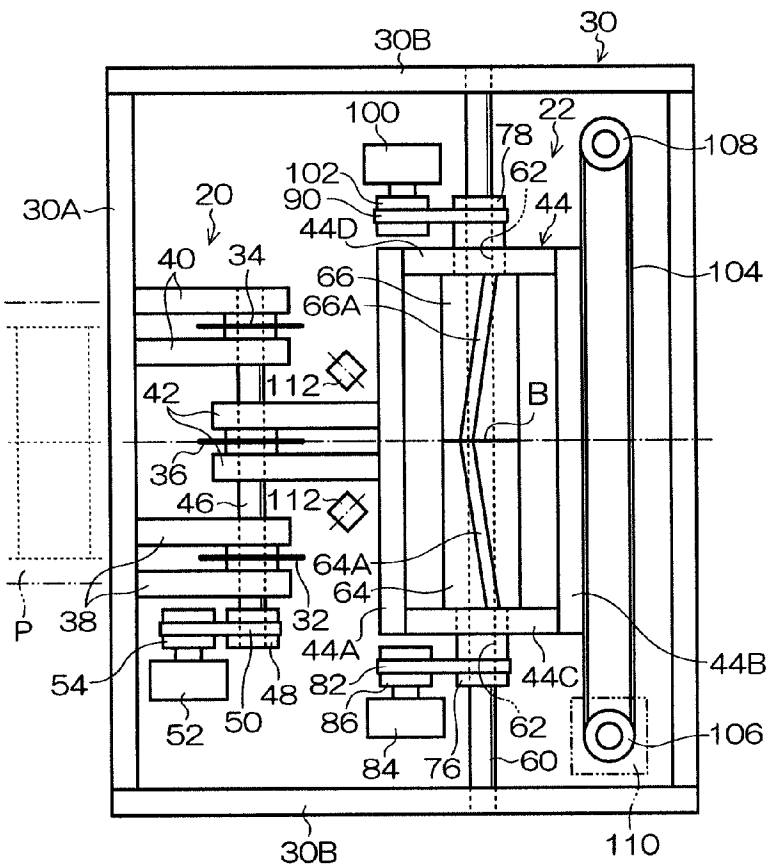

This drive belt 104 is wrapped around pulleys 106 and 108 that are disposed on both end portions in the width direction of the continuous paper P, and when a stepping motor 110 that is coupled to the pulley 106 is driven, the coupling portion of the drive belt 104 moves a predetermined amount via the pulleys 106 and 108 along the width direction of the continuous paper P that is transported (see FIG. 7A and FIG. 7B).

Additionally, the support body 44 moves via the coupling portion along the width direction of the continuous paper P that is transported. Here, the stepping motor 110 is connected to the controller 88 (see FIG. 5) of the paper processing system 12 and is driven in accordance with an instruction from the controller 88.

Here, the unnecessary portions 56 are formed in the continuous paper P by an instruction from the controller 88, and the support body 44 is moved within the range of the unnecessary portions 56. In other words, in the continuous paper P, the support body 44 moves while the unnecessary portions 56 pass. The unnecessary portions 56 are collected in the waste paper collection bin 58 (see FIG. 1). When printing is to be performed on the upstream side of the slitter unit 20, the unnecessary portion 56 becomes white paper state without printing being performed thereon by an instruction from the controller 88.

It will be noted that, here, the pulleys 106 and 108 and the drive belt 104 are used in order to move the support body 44, but the invention is not particularly limited as long as the support body 44 can be moved. For example, instead of the pulleys 106 and 108 and the drive belt 104, a sprocket and a chain may also be used, or a mechanism that uses a pinion and a rack may also be used.

The pair of shaft support plates 42 extend from the center of the outer surface of the support plate 44A along the transporting direction of the continuous paper P. The center slitter 36 of the slitter unit 20 is rotatably pivotally supported on these support plates 42. For this reason, when the support body 44 moves, the position of the center slitter 36 also changes via the shaft support plates 42.

Consequently, first, beforehand, when the position of a boundary portion B between the cutting portion 64 and the cutting portion 66 of the cutter unit 22 is aligned with the position of the center slitter 36 of the slitter unit 20, the position of the center slitter 36 and the position of the boundary portion B between the cutting portion 64 and the cutting portion 66 always coincide.

Here, an unillustrated groove portion is formed along the axial direction of the shaft 46 in the outer peripheral surface of the shaft 46 of the center slitter 36, and a projection that fits together with this groove portion is formed in the center slitter 36. When the shaft 46 rotates, the center slitter 36 rotates integrally with the shaft 46 via the groove portion and the projection, and when the center slitter 36 moves, the projection moves inside the groove portion such that it becomes possible for the position of the center slitter 36 to be changed in the axial direction of the shaft 46.

Further, on the outer sides of the shaft support plates 42, on the downstream side of the slitter unit 20, there are disposed feeding rollers (feeding members) 112 that are disposed diagonally so as to face outward from the upstream side to the downstream side of the continuous paper P that is transported, and the feeding rollers 112 contact the continuous papers P that has been cut by the center slitter 36 and feed the continuous papers P in directions away from each other. These feeding rollers 112 are also disposed integrally with the support body 44 and are configured to move in accompaniment with the movement of the support body 44.

As described above, paper a and paper b that have been cut into a predetermined size by the slitter unit 20 and the cutter unit 22 of the paper processing device 10 are respectively guided to paper stackers 26 and 28 and the like by a paper guiding device 24 that is disposed on the downstream side of the paper processing device 10.

<Paper Guiding Device>

Figure 4:
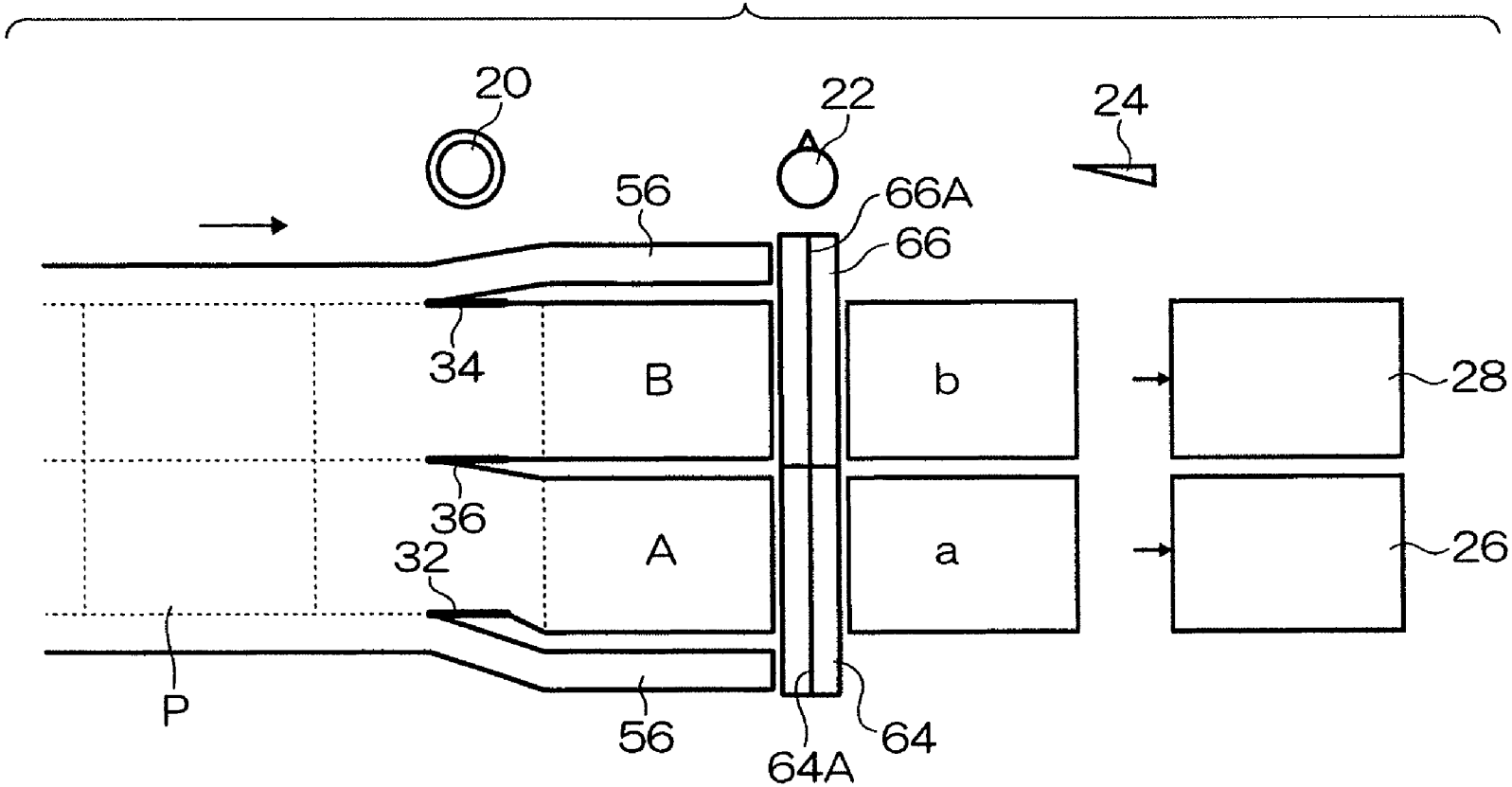
FIG. 4 is an explanatory diagram describing the action of the paper processing device pertaining to the exemplary embodiment.

As shown in FIG. 2 to FIG. 4, in the paper guiding device 24, guiding members 114 and 116 are disposed in correspondence to the paper a and the paper b that have been divided in their width direction by the slitter unit 20, and the guiding members 114 and 116 respectively guide the paper a and the paper b that have been cut into a predetermined size by the slitter unit 20 and the cutter unit 22 to the paper stackers 26 and 28 and the like that are disposed on the downstream side.

The guiding members 114 and 116 are formed in plate shapes, and the upstream sides of the guiding members 114 and 116 in the transporting direction of the paper a and the paper b slant downward to ensure that the leading end portions of the paper a and the paper b that have been transported do not become caught on the guiding members 114 and 116. Further, on the downstream sides of the guiding members 114 and 116 in the transporting direction of the paper a and the paper b, shaft portions 118 are respectively disposed along the width direction of the guiding members 114 and 116 (the width direction of the continuous paper P that is transported).

Shaft holes 120 penetrate these shaft portions 118, and one shaft 122 that is fixed to an unillustrated shaft support plate is inserted through the shaft holes 120 such that the guiding members 114 and 116 become rotatable with respect to the shaft 122. Pushing pieces 124 and 126 project along the width direction of the guiding members 114 and 116 from side end surfaces on the free end sides of these guiding members 114 and 116.

Racks 115 and 117 are respectively disposed on the shaft portion 118 side of the guiding members 114 and 116, and pinions 119 and 121 respectively mesh with the racks 115 and 117. These pinions 119 and 121 are respectively coupled to drive motors 123 and 125, and when the drive motors 123 and 125 are driven, the pinions 119 and 121 rotate such that the guiding members 114 and 116 move by the pinions 119 and 121 via the racks 115 and 117 along the width direction of the paper a and the paper b that are transported.

These drive motors 123 and 125 are connected to the controller 88 (see FIG. 5) of the paper processing system 12 and are driven in accordance with an instruction from the controller 88. The drive motors 123 and 125 are synchronized to ensure that the guiding member 114 and the guiding member 116 are always moved at the same speed, whereby the end surface of the guiding member 114 and the end surface of the guiding member 116 always contact each other to ensure that a clearance is not formed between the guiding member 114 and the guiding member 116. Additionally, due to the movement of the guiding member 114 and the guiding member 116, a boundary portion Q between the guiding member 114 and the guiding member 116 can be aligned with the position of the center slitter 36.

It will be noted that, here, moving members (the racks 115 and 117, the pinions 119 and 121 and the drive motors 123 and 125) are respectively disposed for the guiding member 114 and the guiding member 116, but because the guiding member 114 and the guiding member 116 always move together, the invention may also be configured such that the guiding member 114 and the guiding member 116 are moved via the guiding member 114 (or the guiding member 116) using a motive force transmitting member such as a pulley and a belt.

The distal end portions of plungers 130 and 131 of solenoids 128 and 129 contact the upper surfaces of the pushing pieces 124 and 126 that project from the side end surfaces on the free end sides of the guiding members 114 and 116. These solenoids 128 and 129 are respectively connected to the controller 88 (see FIG. 5) of the paper processing system 12 and are driven in accordance with an instruction from the controller 88.

The free end side of the guiding member 114 (the guiding member 116) is energized upward by an unillustrated energizing member, and in a state where the solenoid 128 (the solenoid 129) is OFF, the guiding member 114 (the guiding member 116) has been horizontally maintained and the guiding member 114 (the guiding member 116) horizontally guides the paper a (or the paper b) that has been transported.

When the solenoid 128 (the solenoid 129) is switched ON, the plunger 130 (the plunger 131) moves upward and the free end side of the guiding member 114 (the guiding member 116) is flipped up about the shaft 122 by the energizing force of the energizing member. Thus, the paper a (the paper b) that has been transported is guided downward.

Depending on the paper, there are also cases where binding and stitching are performed after cutting, so there are also cases where these post-processing device are disposed on the downstream side of the paper processing device 10, and the transporting paths of the paper a and the paper b are selected depending on whether the paper a and the paper b are to be guided to the post-processing device or collected in the paper stackers 26 and 28. It will be noted that there are also cases where, when the papers are to be guided to post-processing device, the papers are first collected in the paper stackers.

Further, here, the solenoids 128 and 129 are used, but the invention is not limited to this because it suffices as long as the slopes of the guiding members 114 and 116 can be changed. For example, although they are not illustrated, the invention may also be configured such that eccentric cams are used and such that the slopes of the guiding members 114 and 116 are changed by the angle of rotation of the eccentric cams.

Figure 8:
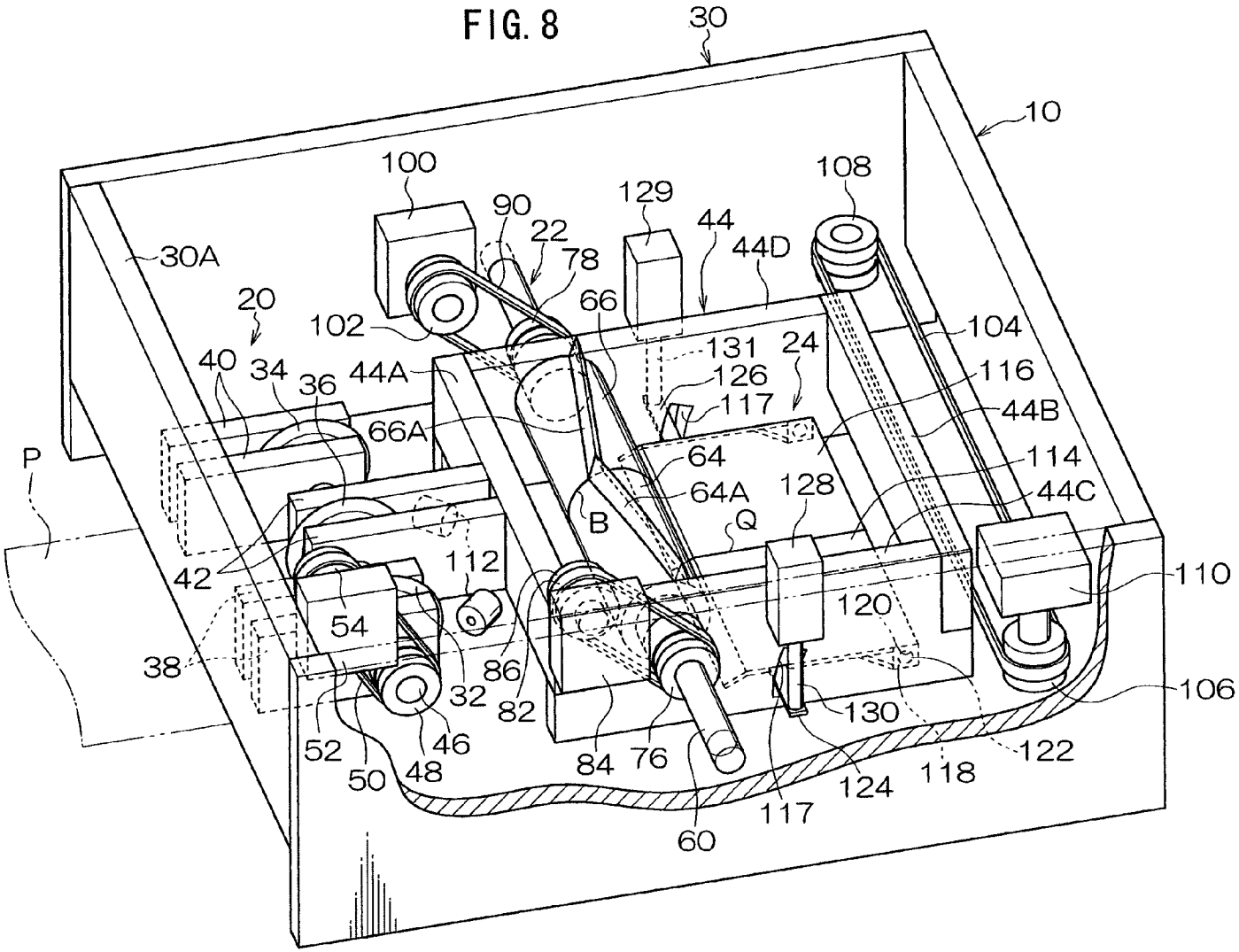
FIG. 8 is a perspective diagram showing a first modification of the paper processing device and the paper guiding device pertaining to the exemplary embodiment.
Figure 9A:
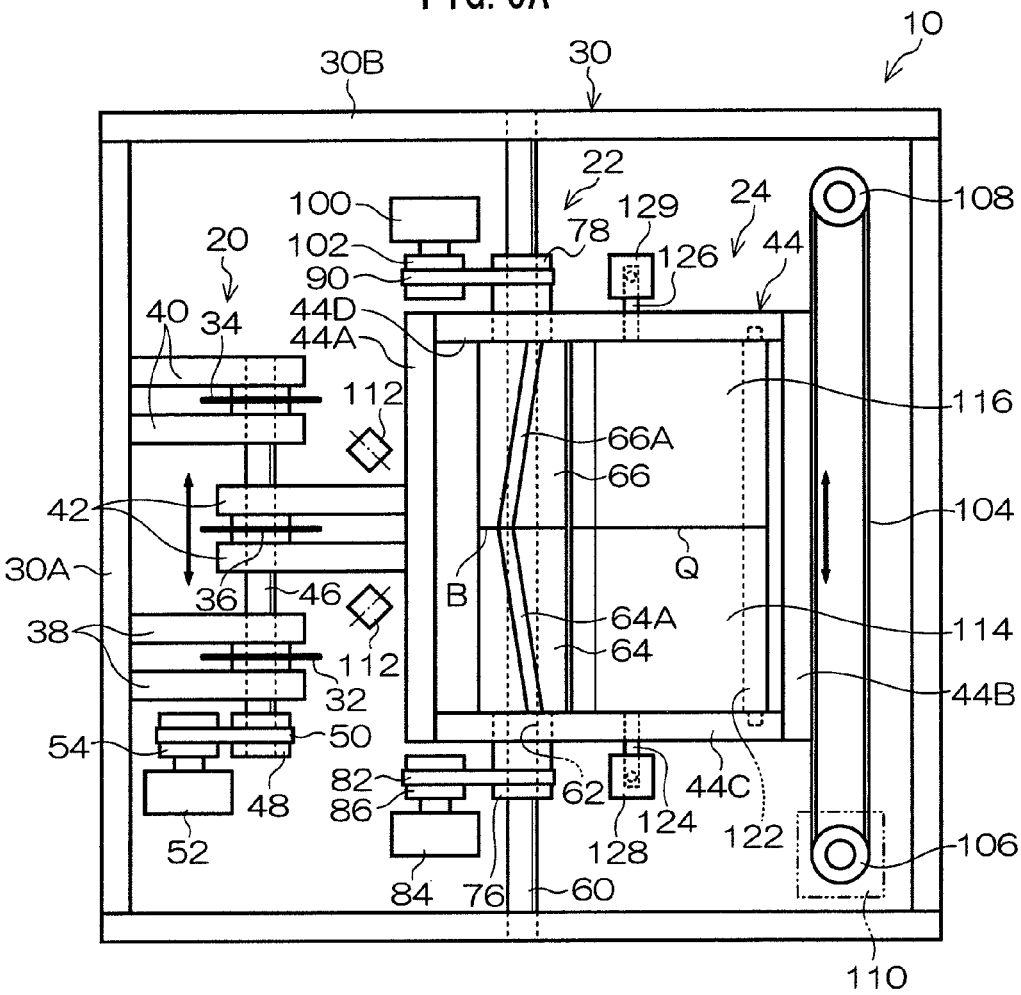
FIG. 9A and FIG. 9B are diagrams showing the first modification of the paper processing device and the paper guiding device pertaining to the exemplary embodiment, with FIG. 9A being a plan diagram and FIG. 9B being a front diagram.
Figure 9B:
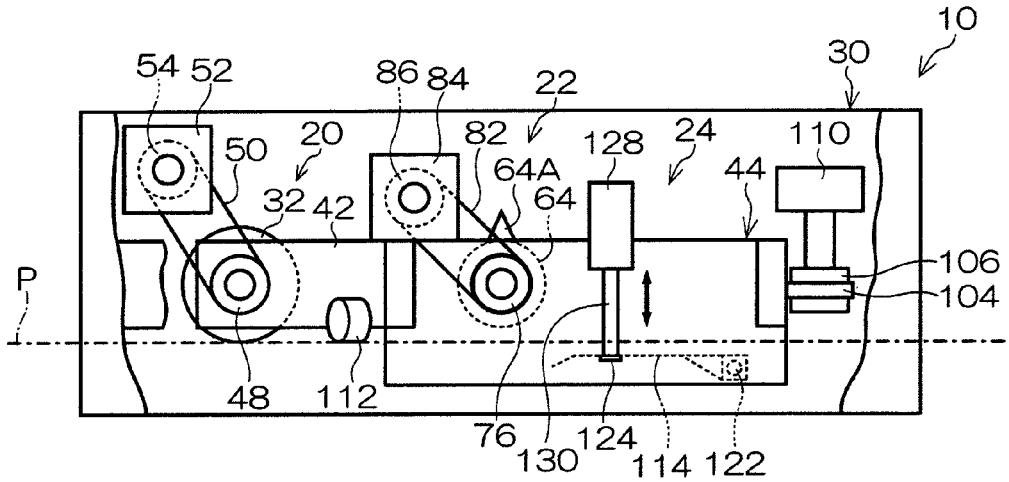

Incidentally, in the present exemplary embodiment, the paper processing device 10 and the paper guiding device 24 are disposed separately, but as shown in FIG. 8, FIG. 9A and FIG. 9B, the paper guiding device 24 may also be disposed inside the frame body 30 of the paper processing device 10. In this case, the shaft 122 that penetrates the shaft holes 120 that are respectively disposed along the width direction of the guiding members 114 and 116 is fixed to the support plates 44C and 44D of the support body 44.

Further, circular arc-shaped penetration holes 117 penetrate the support plates 44C and 44D, and the pushing pieces 124 and 126 that project from the side end surfaces of the guiding members 114 and 116 penetrate the penetration holes 117. Additionally, the distal end portions of the plungers 130 and 131 of the solenoids 128 and 129 that are respectively disposed on the support plates 44C and 44D contact the distal end portions of these pushing pieces 124 and 126. Here, the position of the boundary portion Q between the guiding member 114 and 116 coincides with the boundary portion B between the cutting portion 64 and the cutting portion 66 of the cutter unit 22.

In this manner, in a case in which the paper guiding device 24 is disposed inside the frame body 30 of the paper processing device 10, the paper guiding device 24 also moves due to the movement of the support body 44. For this reason, in this case, the racks 115 and 117, the pinions 119 and 121 and the drive motors 123 and 125 that move the guiding member 114 and the guiding member 116 shown in FIG. 2 become unnecessary.

The paper guiding device 24 as described above is configured such that the width dimensions of the guiding members 114 and 116 are made constant, the entire paper guiding device 24 is moved in the width direction of the continuous paper P that is transported, and the position of the boundary portion Q between the guiding member 114 and the guiding member 116 is changed, but the width dimensions of the guiding members 114 and 116 may also be made variable.

Figure 10:
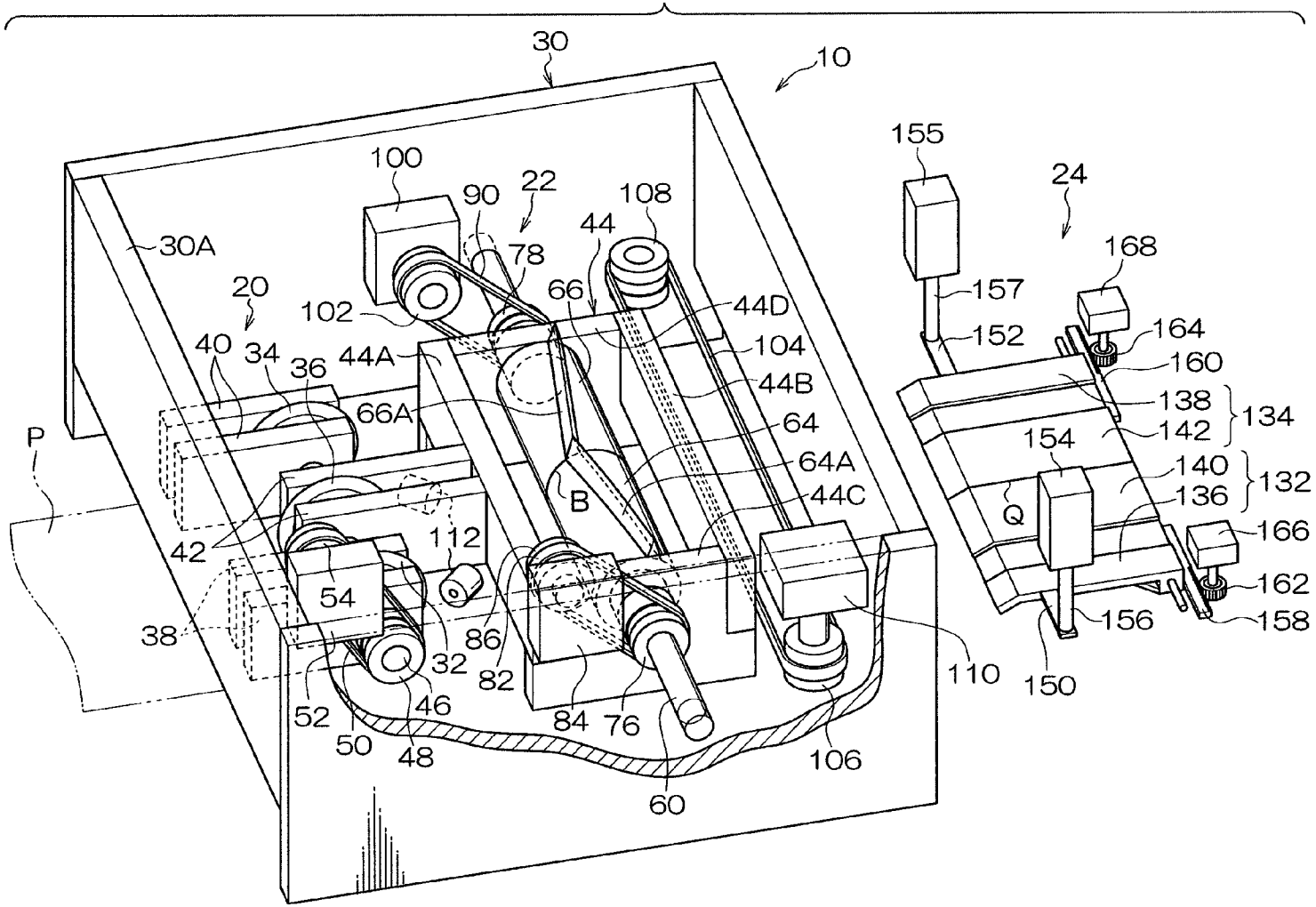
FIG. 10 is a perspective diagram showing a second modification of the paper processing device and the paper guiding device pertaining to the exemplary embodiment.
Figure 11:
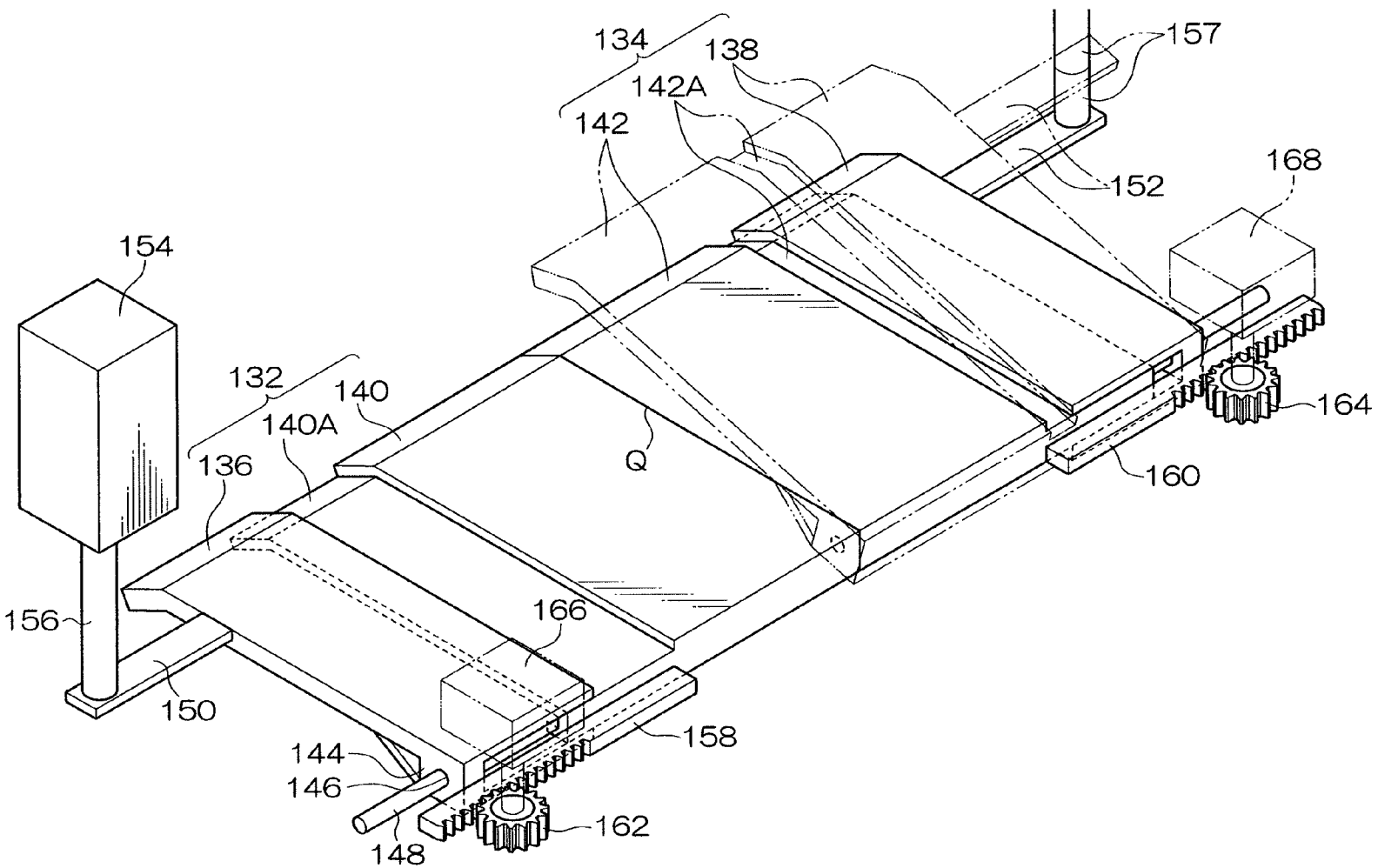
FIG. 11 is a perspective diagram showing the second modification of the paper guiding device pertaining to the exemplary embodiment.

For example, one example may include the configuration shown in FIG. 10 and FIG. 11. Guiding members 132 and 134 shown in FIG. 10 and FIG. 11 include fixed guide plates 136 and 138 and moving guide plates 140 and 142 that are formed in plate shapes, and the boundary portion Q between the guiding member 132 and the guiding member 134 is set by the movement of the moving guide plates 140 and 142.

Specifically, smooth surfaces 140A and 142A that are formed one step lower than the upper surfaces of the moving guide plates 140 and 142 along the transporting direction of the paper a and the paper b are disposed on the outer sides of the upper surfaces of the moving guide plates 140 and 142. The fixed guide plates 136 and 138 are disposed so as to cover these smooth surfaces 140A and 142A, and the smooth surfaces 140A and 142A are configured to be movable along the undersurfaces of the fixed guide plates 136 and 138.

The upper surfaces (guide surfaces) of the fixed guide plates 136 and 138 and the upper surfaces (guide surfaces) of the moving guide plates 140 and 142 are formed so as to be substantially in the same plane, with the paper a being guided by the upper surface of the fixed guide plate 136 and the upper surface of the moving guide plate 140, and with the paper b being guided by the upper surface of the fixed guide plate 138 and the upper surface of the moving guide plate 142.

On the downstream sides of the fixed guide plates 136 and 138 and the moving guide plates 140 and 142 in the transporting direction of the paper a and the paper b, shaft portions 144 are respectively disposed along the width direction of the guiding members 132 and 134, shaft holes 146 penetrate these shaft portions 144, and one shaft 148 that is fixed to an unillustrated support portion is inserted through the shaft holes 146 such that the fixed guide plates 136 and 138 and the moving guide plates 140 and 142 are made rotatable with respect to the shaft 148.

Pushing pieces 150 and 152 project along the width direction of the guiding members 132 and 132 from side end surfaces on the free end sides of the fixed guide plates 136 and 138, and the distal end portions of plungers 156 and 157 of solenoids 154 and 155 contact the distal end portions of the pushing pieces 150 and 152. The free end sides of the moving guide plates 140 and 142 are energized upward by unillustrated energizing members and energize the fixed guide plates 136 and 138 upward via the smooth surfaces 140A and 142A of the moving guide plates 140 and 142.

In a state where the solenoid 154 (the solenoid 155) is OFF, the guiding member 132 (the guiding member 134) has been horizontally maintained and the guiding member 132 (the guiding member 134) horizontally guides the paper a (the paper b) transported, but when the solenoid 154 (the solenoid 155) is switched ON, the plunger 156 (the plunger 157) moves upward, the free end side of the guiding member 132 (the guiding member 134) is flipped up by the energizing force of the energizing member, and the paper a (the paper b) that has been transported is guided downward.

Racks 158 and 160 are respectively disposed on the shaft portion 144 side of the moving guide plates 140 and 142, and pinions 162 and 164 respectively mesh with the racks 158 and 160. These pinions 162 and 164 are respectively coupled to drive motors 166 and 168, and when the drive motors 166 and 168 are driven, the pinions 162 and 164 rotate such that the moving guide plates 140 and 142 move by the pinions 162 and 164 via the racks 158 and 160 along the width direction of the paper a and the paper b that are transported.

These drive motors 166 and 168 are synchronized to ensure that the moving guide plate 140 and the moving guide plate 142 are always moved at the same speed, whereby the end surface of the moving guide plate 140 and the end surface of the moving guide plate 142 always contact each other to ensure that a clearance is not formed between the moving guide plate 140 and the moving guide plate 142.

Additionally, due to the movement of the moving guide plate 140 and the moving guide plate 142, the width dimensions of the guiding members 132 and 134 can be made variable and the boundary portion Q between the guiding member 132 and the guiding member 134 can be aligned with the position of the center slitter 36.

It will be noted that, here, moving members (the racks 158 and 160, the pinions 162 and 164 and the drive motors 166 and 168) are respectively disposed for the moving guide plate 140 and the moving guide plate 142, but because the moving guide plate 140 and the moving guide plate 142 always move together, the invention may also be configured such that moving guide plate 140 and the moving guide plate 142 are moved via the moving guide plate 140 (or the moving guide plate 142) using a motive force transmitting member such as a pulley and a belt.

Figure 12B:
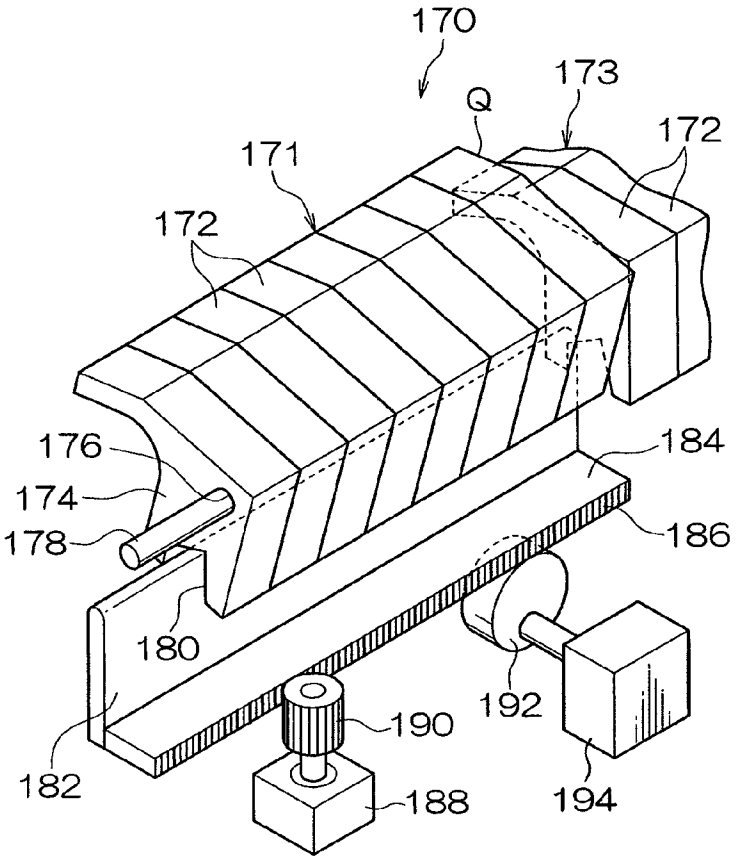
FIG. 12A and FIG. 12B are perspective diagrams showing a third modification of the paper guiding device pertaining to the exemplary embodiment.
Figure 12A:
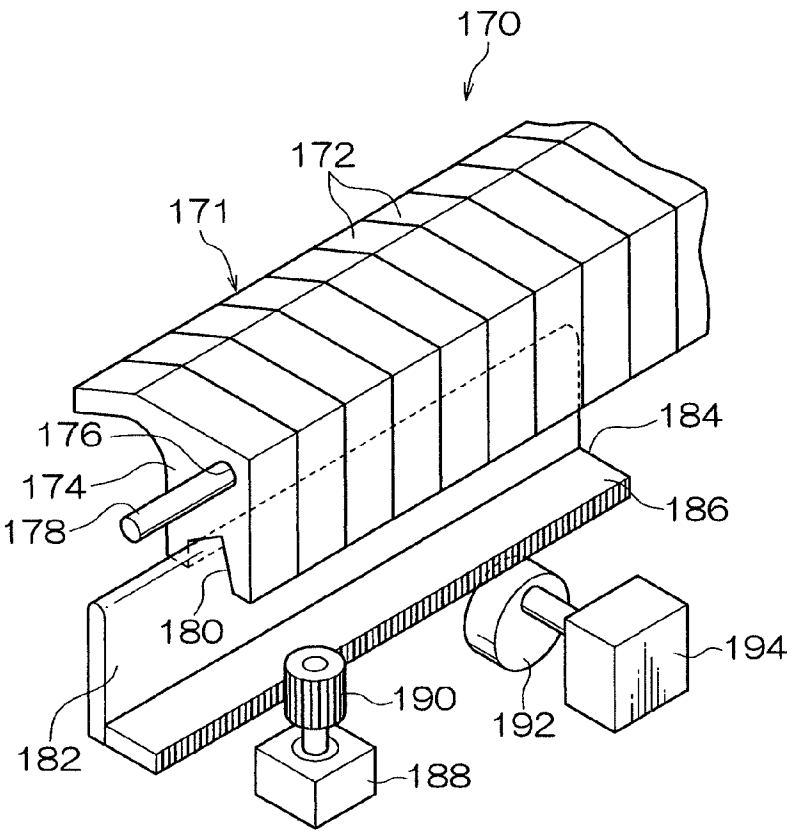

Further, in addition to this, as shown in FIG. 12A and FIG. 12B, a guiding member 170 may be configured by plural guiding pieces 172, and the plural guiding pieces 172 may be supported such that the slopes of the plural guiding pieces 172 may be changed. Specifically, shaft portions 174 are disposed on the downstream sides of the guiding pieces 172 in the transporting direction of the paper a and the paper b, and shaft holes 176 penetrate these shaft portions 174. Additionally, one shaft 178 that is fixed to an unillustrated support portion is inserted through the shaft holes 176 in the guiding pieces 172 such that the guiding pieces 172 are made rotatable with respect to the shaft 178.

Further, on the downstream side of the shaft portions 174, fitting grooves 180 are formed along the width direction of the guiding member 170. A fitting rib 182 is made capable of being fitted into the fitting grooves 180. In a state where this fitting rib 182 has been fitted into the fitting grooves 180, the guiding pieces 172 into which the fitting rib 182 is fitted become integrated, and a guiding portion 171 is formed. It will be noted that the guiding pieces 172 into which the fitting rib 182 is not fitted form a guiding portion 173.

On the base portion of the fitting rib 182, there is disposed an operating piece 184 that is orthogonal to the fitting rib 182. A rack 186 is formed on this operating piece 184, and a pinion 190 to which a drive motor 188 is coupled is caused to mesh with the rack 186. The drive motor 188 is driven, whereby the pinion 190 rotates and the operating piece 184 moves via the rack 186. Thus, the fitting rib 182 moves in the fitting grooves 180 in the guiding pieces 172.

The outer peripheral surface of a circular column-shaped eccentric cam 192 contacts the lower portion of the operating piece 184. A stepping motor 194 is coupled to this eccentric cam 192, and the eccentric cam 192 is rotated a predetermined angle by the driving of the stepping motor 194. Due to the rotation of this eccentric cam 192, the height of the operating piece 184 that contacts the outer peripheral surface of the eccentric cam 192 changes.

Plays are provided between the fitting rib 182 and the fitting grooves 180, and the height of the fitting rib 182 is raised and lowered about the shaft 178, whereby the fitting groove 180 tilts with respect to the fitting rib 182 in correspondence to the amount of the play to change the slope of the guiding portion 171.

Here, the guiding member 170 is divided into the guiding portion 171 that is configured by the guiding pieces 172 into which the fitting rib 182 fits and the guiding portion 173 that is configured by the guiding pieces 172 into which the fitting rib 182 does not fit, so the boundary portion Q between the guiding portion 171 and the guiding portion 173 is made to coincide with the boundary portion B by moving the fitting rib 182 in accordance with the position of the boundary portion B between the cutting portion 64 and the cutting portion 66 of the cutter unit 20.

Next, the operation of this paper processing device 10 will be described.

As shown in FIG. 1, the continuous paper P that has been supplied from the continuous paper supplying device 14 is transported to the paper buffer mechanism 16, where the tension in the continuous paper P is adjusted, and the continuous paper P is transported to the paper processing device 10. In the paper processing device 10, the continuous paper P is cut into a desired size by the slitter unit 20 and the cutter unit 22 in accordance with the size of the continuous paper P that is transported.

First, as shown in FIG. 4, the continuous paper P is cut along the transporting direction of the continuous paper P by the slitter unit 20. The continuous paper A and the continuous paper B that have been cut by the center slitter 36 that is disposed in the slitter unit 20 are guided outward, such that they do not overlap each other, by the feeding rollers 112 (see FIG. 2) and are transported to the cutter unit 22.

Figure 13:
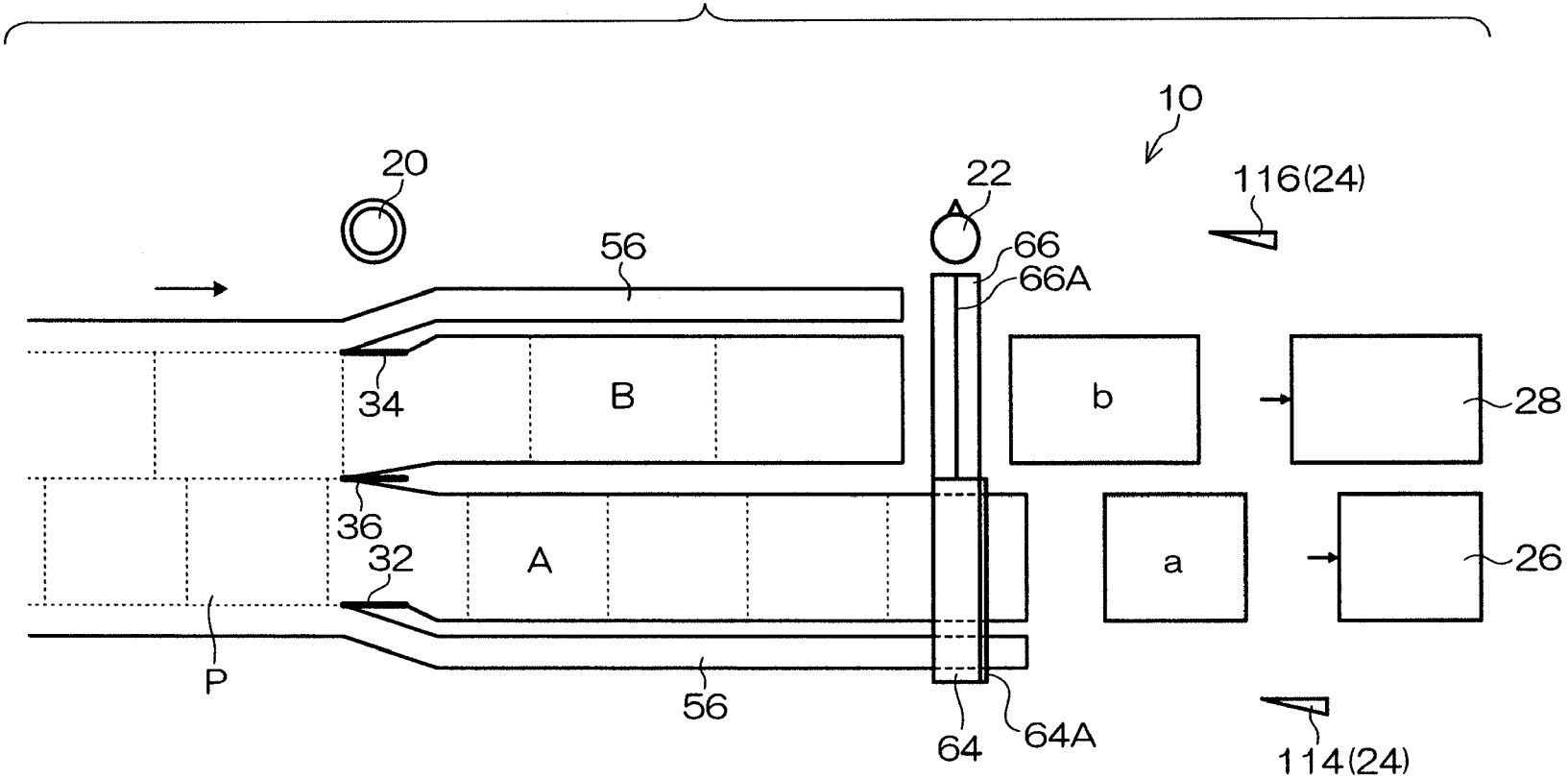
FIG. 13 is an explanatory diagram describing the action of the paper processing device pertaining to the exemplary embodiment.

As shown in FIG. 4, in a case where the two continuous papers A and B are obtained in the width direction of the continuous paper P that is transported, as long as the lengths of the paper a and the paper b are the same, there is no problem even when the entire width of the continuous paper P is cut by the cutter unit 22. However, as shown in FIG. 13, in a case where the lengths of the paper a and the paper b are different, the entire width of the continuous paper P cannot be cut by the cutter unit 22.

For this reason, in the exemplary embodiment of the present invention, in the cutter unit 22, the plural cutting portions 64 and 66 are disposed along the width direction of the continuous paper P, and the drive motors 84 and 100 that respectively drive the cutting portions 64 and 66 are individually disposed such that the cutting portions 64 and 66 are made rotatable in a state where they are independent of each other. Additionally, the drive motors 84 and 100 shown in FIG. 2 are respectively rotated at predetermined rotational speeds by an instruction from the controller 88 (see FIG. 5) such that the cutting portions 64 and 66 are individually rotated.

Thus, the continuous paper A is cut along its width direction by the cutting portion 64, and the continuous paper B is cut along its width direction by the cutting portion 66. In other words, the continuous paper A and the continuous paper B are continuously cut by single cutting device despite the desired paper sizes (paper a and paper b) differing in the continuous paper A and the continuous paper B that are transported.

For example, in the case of papers of different sizes, such as when there is a difference in the amount of information that is required by each customer or when different ledger forms are to be collectively processed, a drop in total performance resulting from paper setup between jobs and needless consumption of the continuous papers A and B that accompanies switching and setup of the continuous papers A and B can be prevented without making post-processing device complex, and the continuous papers A and B can be variably and continuously cut into desired paper sizes (paper a and paper b).

In this manner, the paper a and the paper b that have been cut into desired sizes are respectively transported to the paper guiding device 24 that is positioned on the downstream side of the cutter unit 22. In the paper guidance device 24, the transporting paths of the paper a and the paper b are switched such that the paper a and the paper b are respectively guided to the paper stackers 26 and 28 by the guiding members 114 and 116.

Further, here, the width direction dimensions of the continuous paper A and the continuous paper B are substantially the same, but as shown in FIG. 13, the width direction dimensions of the continuous paper A and the continuous paper B can also be changed. In this case, the position of the center slitter 36 is changed, that is, the support body 44 that is disposed with the shaft support plates 42 that support the center slitter 36 shown in FIG. 2 is moved.

An instruction to rotate the stepping motor 110 by a predetermined angle is issued from the controller 88 (see FIG. 5). Thus, the stepping motor 110 rotates by the predetermined angle, and the support body 44 moves via the drive belt 104 and the coupling portion along the width direction of the continuous paper P that is transported.

In accompaniment therewith, in the cutter unit 22, the position of the boundary portion B between the cutting portion 64 and the cutting portion 66 shifts, and the position of the center slitter 36 shifts. In this manner, by disposing the center slitter 36 integrally with the support body 44, the position of the center slitter 36 and the position of the boundary portion B between the cutting portion 64 and the cutting portion 66 can be made to always coincide.

Here, in relation to the movement of the support body 44, the unnecessary portion 56 is formed in the continuous paper P by an instruction from the controller 88, and it is ensured that the support body 44 is moved while the unnecessary portion 56 passes, whereby there is no need to stop the paper processing device 10. It will be noted that in a case where the guiding members 114 and 116 are disposed separately from the support body 44, the guiding members 114 and 116 are also moved while the unnecessary portion 56 passes.

The feeding rollers 112 are disposed between the center slitter 36 and the support body 44, and the continuous paper A and the continuous paper B that have been cut by the center slitter 36 are fed outward so caused to move away from each other to ensure that the continuous paper A and the continuous paper B do not overlap. Additionally, these feeding rollers 112 are disposed integrally with the support body 44, whereby the position of the center slitter 36 and the center position between the feeding rollers 112 can be made to always coincide.

As shown in FIG. 8, by disposing the paper guiding device 24 in the support body 44, the position of the boundary portion Q between the guiding member 114 and the guiding member 116 can be aligned with the position of the boundary portion B between the cutting portion 64 and the cutting portion 66 of the cutter unit 22 and with the position of the center slitter 36.

Consequently, the continuous paper A and the continuous paper B that have been cut by the center slitter 36 can be respectively cut into the paper a and the paper b by the cutter unit 22, and the paper a and the paper b can be reliably guided to predetermined transporting paths by the guiding members 114 and 116.

In this manner, the slitter unit 20, the cutter unit 22 and the paper guiding device 24 are disposed on the support body 44, and the support body 44 is configured to be movable along the width direction of the continuous paper P that is transported, so the slitter unit 20, the cutter unit 22 and the paper guiding device 24 always move together via the support body 44.

For this reason, the position of the center slitter 36, the position of the boundary portion B between the cutting portion 64 and the cutting portion 66 of the cutter unit 22 and the position of the boundary portion Q between the guiding member 114 and the guiding member 116 always coincide. Thus, the continuous paper A and the continuous paper B that have been cut by the center slitter 36 can be respectively cut into the paper a and the paper b by the cutter unit 22, and the paper a and the paper b can be reliably guided to predetermined transporting paths.

Figure 14:
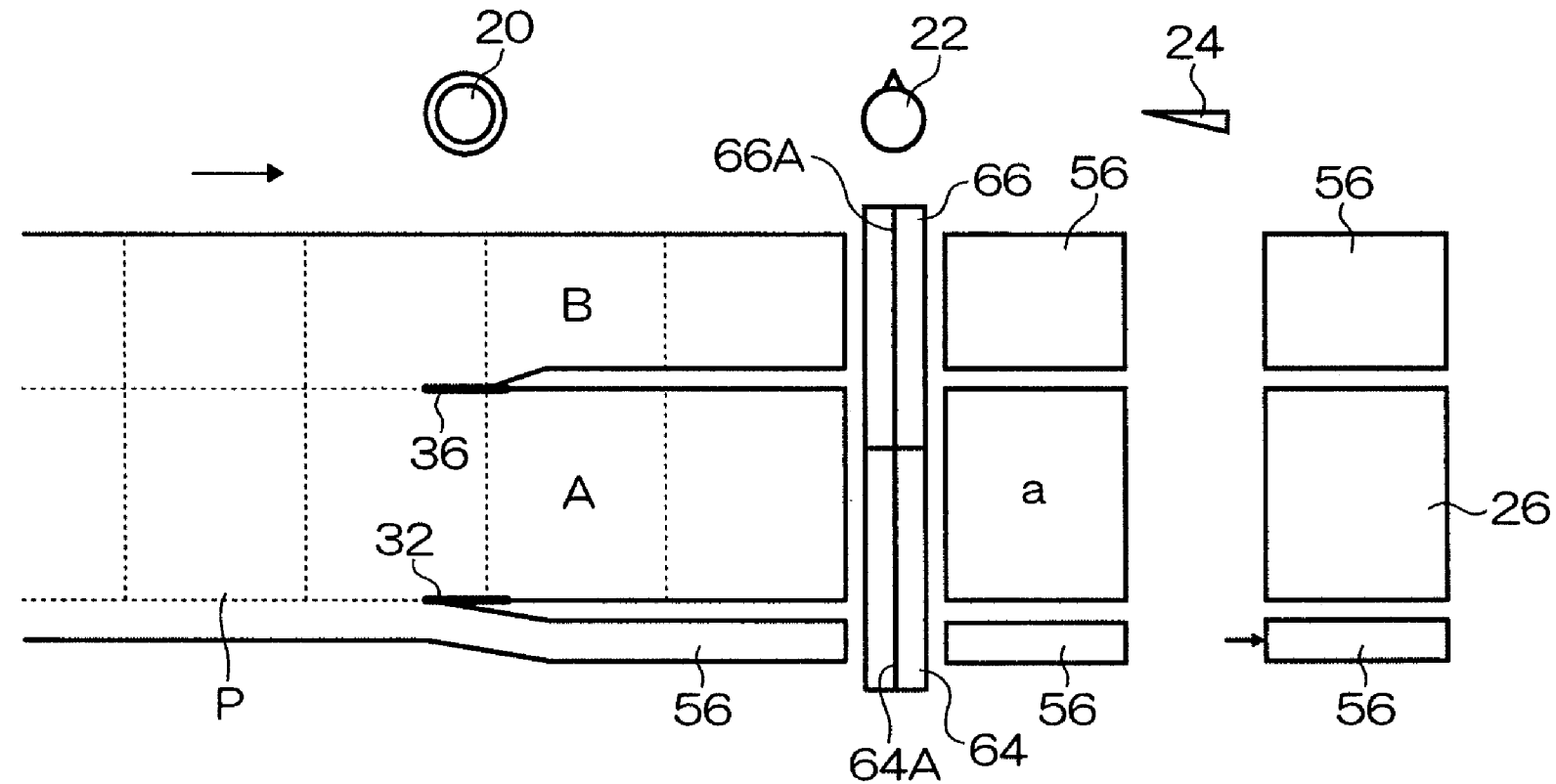
FIG. 14 is an explanatory diagram describing the action of the paper processing device pertaining to the exemplary embodiment.

Incidentally, depending on the paper size, as shown in FIG. 14, a case also arises where only one sheet of paper can be obtained in the width direction of the continuous paper P, such as a case where a predetermined paper size cannot be obtained on the continuous paper B side. In this case, the number of slitters that are used in the slitter unit 20 is made two such that the side slitter 32 and the center slitter 36 are used.

Specifically, the coupling 47 (see FIG. 5) becomes non-conductive by the controller 88 (see FIG. 5), the solenoid 35 is switched ON, and the side slitter 34 moves upward and is placed in a non-cutting state. At this time, in the cutter unit 22 shown in FIG. 8, the drive motor 84 and the drive motor 110 are synchronized, and the continuous paper P that is transported is cut in a state where the cutting portion 64 and the cutting portion 66 have been integrated (see FIG. 14).

The preceding exemplary embodiment is only one exemplary embodiment and is of course capable of being appropriately altered within a range that does not depart from the gist of the present invention.

What is claimed is:

1. A paper processing device comprising:

a first cutting unit that cuts a transported continuous paper along a transporting direction of the continuous paper to change a width of the continuous paper;

a second cutting unit that cuts continuous papers, which have been formed by cutting with the first cutting unit, along a width direction of the cut continuous papers to cut the continuous papers into papers of a desired size, the second cutting unit including:

a plurality of second cutting members disposed along the width direction of the cut continuous papers, and a plurality of driving units that respectively drive the second cutting members; and a moving unit that moves the second cutting unit along the width direction of the cut continuous papers, wherein the first cutting unit includes a first cutting member that is movable along the width direction of the continuous paper, and wherein the moving unit moves the second cutting unit integrally with the first cutting member.

2. The paper processing device of claim 1, further comprising feeding members that are positioned between the first cutting unit and the second cutting unit and feed, in directions away from each other, the continuous papers cut by the first cutting unit.

3. The paper processing device of claim 1, further comprising a plurality of guiding members that are respectively disposed, along the width direction of the cut continuous papers, at a downstream side of the second cutting unit in the transporting direction, and that respectively guide the papers cut by the second cutting unit to the downstream side in the transporting direction, and a guidance direction switching member that moves the guiding members to switch transporting paths on which the cut papers are transported.

4. The paper processing device of claim 3, further comprising an aligning member that aligns a position of a boundary portion between the guiding members with a position of a boundary portion between the second cutting members.

5. The paper processing device of claim 4, wherein the aligning member is a support body to which the second cutting members and the guiding members are aligned and attached.

6. The paper processing device according to claim 1, wherein the plurality of driving units are synchronously operated to integrally drive the plurality of second cutting members.

7. The paper processing device of claim 1, further comprising a controller that controls movement of the second cutting unit, wherein the controller forms an unnecessary portion in the transported continuous paper at an upstream side of the second cutting unit in the transporting direction and moves the second cutting unit while the unnecessary portion passes a region of the second cutting unit.

8. The paper processing device of claim 1, wherein the first cutting member is pivotally supported at a shaft support portion that is provided at the second cutting unit, and a position of the first cutting member is aligned with a position of a boundary portion between the second cutting members of the second cutting unit.

9. The paper processing device according to claim 1, wherein the plurality of second cutting members are arranged such that a line extending parallel to the width direction of the cut continuous papers passes through all of the plurality of second cutting members.

10. The paper processing device according to claim 1, wherein the plurality of second cutting members rotate about a common axis extending parallel to the width direction of the cut continuous papers.

11. The paper processing device of claim 3, wherein the plurality of guiding members and the second cutting unit are provided at a support body, and the plurality of guiding members and the second cutting unit are integrally moved by the moving unit.

12. The paper processing device of claim 3, wherein each of the plurality of guiding members includes a fixed guide member and a moving guide member movable in the width direction of the continuous paper.

13. The paper processing device of claim 3, wherein each of the plurality of guiding members is provided with a plurality of guide pieces, capable of changing slopes thereof, that are disposed along the width direction of the continuous paper.

* * * * *